US005160285A

United States Patent [19]

Murray

[11] Patent Number: 5,160,285

[45] Date of Patent: Nov. 3, 1992

[54] SEPARABLE CONTACT ARRANGEMENT

[75] Inventor: Peter Murray, Detmold, Fed. Rep. of Germany

[73] Assignee: C. A. Wieidmüller GmbH & Co., Fed. Rep. of Germany

[21] Appl. No.: 772,442

[22] Filed: Oct. 7, 1991

[30] Foreign Application Priority Data

Oct. 10, 1990 [DE] Fed. Rep. of Germany ..... 4032146

[51] Int. Cl.[5] ..... H01R 4/38

[52] U.S. Cl. ..... 439/801; 439/115; 439/792

[58] Field of Search ..... 439/115, 116, 210, 790-793, 439/801, 810-812

[56] References Cited

U.S. PATENT DOCUMENTS 4,542,953 4/1985 Iwamoto et al. ..... 439/801 X
4,601,531 7/1986 Wider ..... 439/793

FOREIGN PATENT DOCUMENTS 0237388 9/1987 European Pat. Off. ..... 439/115
2430736 4/1977 Fed. Rep. of Germany .
1322932 2/1963 France ..... 439/801

*Primary Examiner*—Eugene F. Desmond
*Attorney, Agent, or Firm*—Laubscher & Laubscher

[57] ABSTRACT

An improved separable contact assembly for joining spaced bus bar segments includes first and second contacts arranged above and below and movable with respect to the bus bar segments. The first contact includes a guide lug guided through a guide opening. The second contact includes an extension for receiving the guide lug after it passes through the opening. A clamping screw clamps the contacts to the bus bar segments.

9 Claims, 1 Drawing Sheet

SEPARABLE CONTACT ARRANGEMENT

BACKGROUND OF THE INVENTION

This invention relates to a separable contact arrangement with two contacts that are arranged above and below a divided bus bar or conductor rail. The clamping members are movably placed between the opposite ends of the divided bus bar and are clamped together with a clamping screw.

In known separable contact arrangements that are often used in series terminals as shown in DE 24 30 736 B2, the clamping members, when the clamping screw is in the open position, i.e., when it is possible to shift the arrangement, have an insufficient hold and insufficient guidance on the opposed end areas of the divided bus bar. Jamming or wedging is frequent during shifting and it is then difficult to close the contacts, in that one cannot push the contacts upon the end of an unconnected bus bar segment with the end having to be engaged in the closing position. This may be remedied to a limited extent by providing undercuts for the bus bar at least in the end areas and by providing special shapes for the contacts. This makes the structural design of such bent metal parts considerably more complicated and thus more expensive. When the contact arrangement of the prior art is in the closing position, forces are applied upon both parts of the divided bus bar during the tightening of the clamping screw, with the result that both bus bar parts, in a surrounding housing or the like, need a special twist-proof and jam-proof anchoring. This again makes production more complicated and more expensive.

SUMMARY OF THE INVENTION

The purpose of this invention therefore is to create a separable contact arrangement of the type involved here which—with a simple structural design—will ensure a guided, jam-proof movement and a reliable connection of the contacts on the bus bar segments. Owing to a guide lug on one of the contacts and the fixing of the end of this guide lug in an extension of the other contact, the two contacts now form one stable, secure-holding composite system that can be moved back and forth reliably and without jamming between the opened position and the closed position of the separable contact arrangement on the segments on the bus bar. The guide lug of one contact is guided in an opening of an adjoining element of the separable contact arrangement. Complicated configurations of the bus bar segments and the contacts are unnecessary. It is especially advantageous that—when the separable contact arrangement is in the closing position—there will develop, between the straining point and the passage point of the guide lug through the adjoining element of the separable contact arrangement, a short, compact force system that ensures a stable, reliable fastening effect.

By way of a practical embodiment, the adjoining guide element is formed with the opening of one bus bar segment itself which to that extent reveals an angular bend. In this way, the entire straining force is practically absorbed only by this one segment of the divided bus bar that is to be anchored in a housing or the like, while the other part of the divided bus bar now no longer requires any special anchoring. In this design, only the strain force absorbing part of the bus bar needs to be provided with an entry slot for the straining screw in the area of the separable contacts.

In another embodiment, the contacts of the separable contact arrangement can each be made as single-piece, simple bent metal parts, one with the guide lug, the other one with the extension to receive the free end of the guide lug.

BRIEF DESCRIPTION OF THE FIGURES

A preferred practical example of a separable contact arrangement according to the invention is described in the following specification with reference to the accompanying drawing, in which.

DETAILED DESCRIPTION

Figure 1:
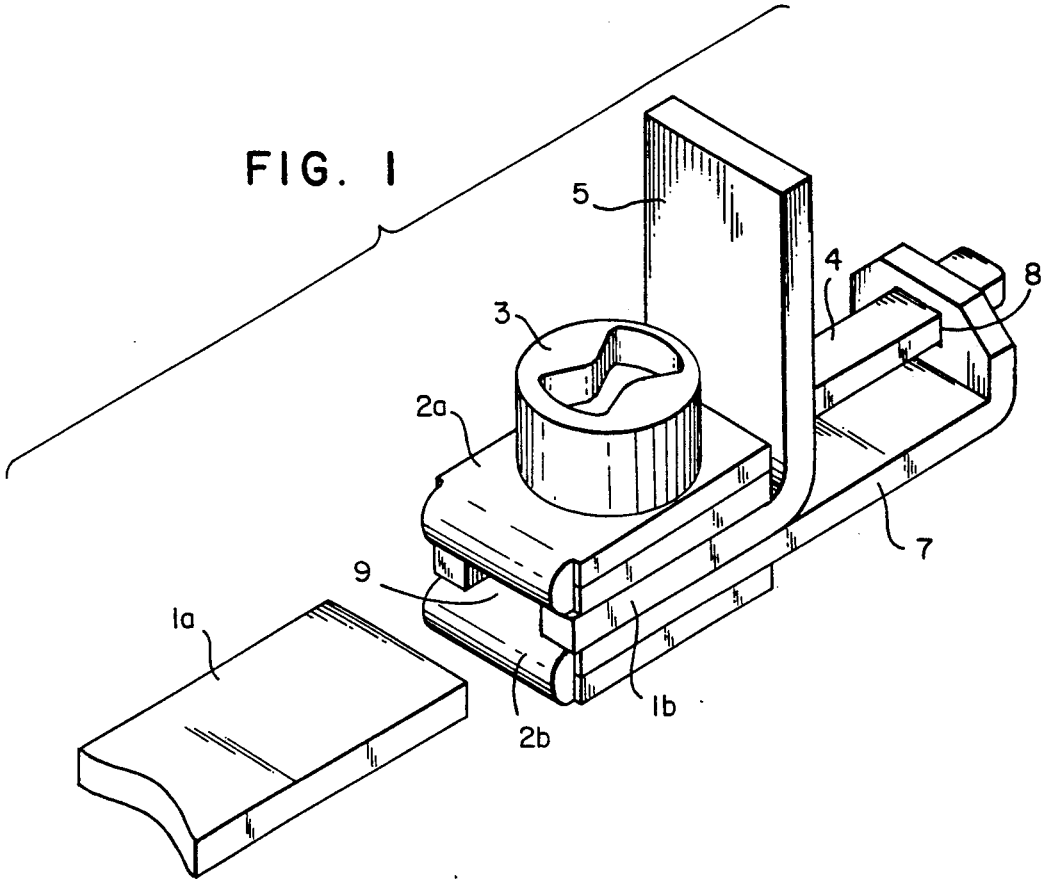
FIG. 1 shows a separable contact arrangement according to the invention in a perspective view with the clamping assembly in the open position.

The separable contact arrangement contains a divided bus bar with two bus bar segments 1*a* and 1*b* that are opposite each other with the ends thereof in the area of the separation point. The separable contact arrangement furthermore contains two contacts 2*a* and 2*b* that are arranged above and below the bus bar segments 1*b* in the open position according to FIG. 1 or above and below the two bus bar segments 1*a*, 1*b* in the closing position according to FIG. 2. The contacts can be moved between the mutually opposed ends of the bus bar segments 1*a* and 1*b* and are joined by a clamping screw 3.

According to the invention in the example illustrated, the upper contact 2*a* has a guide lug 4 that is a rear guide rail, whereby the contact 2*a* is made as a one-piece bent metal part with guide rail 4.

Guide rail 4 is guided in an opening of an adjoining element of the separable contact arrangement. In the example illustrated, the corresponding bus bar segment 1*b* of the divided bus bar forms the adjoining element. Bus bar segment 1*b* for this purpose includes an upwardly-extending leg 5 that, in the corresponding location, has an opening 6 in which guide rail 4 is guided.

The other contact 2*b* also includes an extension in the form of a rear angle piece 7, in whose rear short leg the rear free end of the guide rail 4 is fixed. Contact 2*b* with rear angle piece 7 is also made as a single-piece bent metal part. In the upwardly-bent leg of the angle piece, there is provided a plug-in opening 8 into which the free end of guide rail 4 is inserted after passage through opening 6 in leg 5 of bus bar segment 1*b*.

Figure 2:
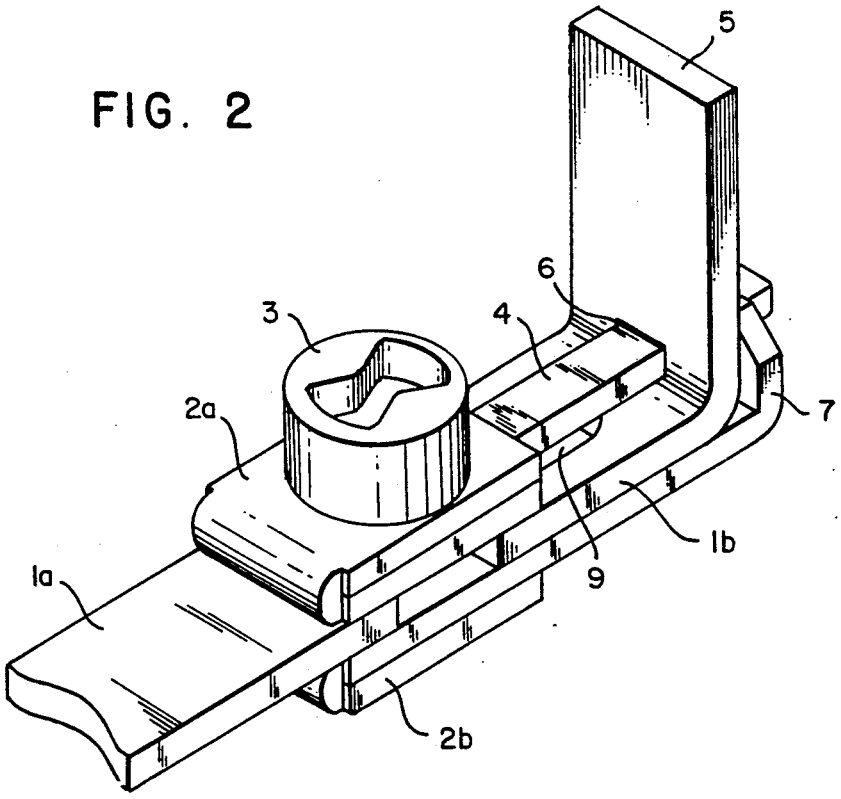
FIG. 2 shows the arrangement according to FIG. 1 with the clamping assembly in the closing position.

Via guide rail 4 and angular extension piece 7, the two contacts 2*a* and 2*b* form a stable, separable contact assembly that via the guidance of guide rail 4 in leg 5 of bus bar segment 1*b* can be guided reliably and without jamming on bus bar segment 1*b*. The assembly can be pushed on the end of the bus bar segment 1*a* to the closing position (FIG. 2). When in the closing position, the straining point, with inclusion of clamping screw 3 and the passage area of guide rail 4 through leg 5 of the bus bar segment 1*b*, forms a compact assembly that absorbs straining forces. To that extent, one bus bar segment 1*b* needs to be secured in an adjoining housing area.

In this design, only the bus bar segment 1*b* needs to be provided, in its end portion in the area of the separation zone, with an entry slot 9 for the shaft of clamping screw 3.

I claim:

1. A separable contact assembly for joining spaced bus bar segments, comprising (a) first and second contacts (2*a*, 2*b*) arranged above and below said bus bar segments, respectively, and movable with respect to said segments, said first contact including a guide lug (4) which is guided through a guide opening (6) in an element of the assembly, said second contact including an extension (7) for receiving said guide leg after passage through the opening; and (b) a clamping screw for clamping said contacts to the bus bar segments.

2. An assembly as defined in claim 1, wherein said guide lug comprises a rearwardly extending guide rail.

3. An assembly as defined in claim 2, wherein said first contact and guide rail are formed as an integral bent metal member.

4. An assembly as defined in claim 1, wherein said second contact extension is formed as a rearwardly extending angle member.

5. An assembly as defined in claim 4, wherein said second contact and rearwardly extending angle member are formed as an integral bent metal member.

6. An assembly as defined in claim 4, wherein said rearwardly extending angle member contains an opening (8) for receiving a free end of said guide rail.

7. An assembly as defined in claim 1, wherein said assembly element containing said guide opening comprises one of said bus bar segments.

8. As assembly as defined in claim 7, wherein said one bus bar segment includes a bent leg portion (5) containing said guide opening.

9. An assembly as defined in claim 7, wherein said one bus bar segment contains an entry slot in an end portion thereof opposing the other bus bar segment, said slot receiving a shaft of said clamping screw.

* * * * *